US005651842A

United States Patent [19]

Nakamura et al.

[11] Patent Number: 5,651,842

[45] Date of Patent: Jul. 29, 1997

[54] HIGH TOUGHNESS HIGH-SPEED STEEL MEMBER AND MANUFACTURING METHOD

[75] Inventors: Hideki Nakamura, Yonago; Junichi Nishida, Yasugi; Norimasa Uchida, Yonago, all of Japan

[73] Assignee: Hitachi Metals, Ltd., Tokyo, Japan

[21] Appl. No.: 600,153

[22] Filed: Feb. 12, 1996

Related U.S. Application Data

[63] Continuation of Ser. No. 241,988, May 13, 1994, abandoned.

[30] Foreign Application Priority Data

May 13, 1993 [JP] Japan ..... 5-135307

[51] Int. Cl.[6] ..... C22C 38/24

[52] U.S. Cl. ..... 148/321; 420/10; 420/101; 420/102

[58] Field of Search ..... 148/543, 612, 148/320, 321; 420/10, 101, 102, 105, 107, 110, 111

[56] References Cited

U.S. PATENT DOCUMENTS

| | | | |
|---|---|---|---|
| 3,211,593 | 10/1965 | Krekeler | 148/320 |
| 4,116,684 | 9/1978 | Uchida et al. | 75/126 |
| 4,224,060 | 9/1980 | de Souza et al. | 420/102 |

FOREIGN PATENT DOCUMENTS

| | | |
|---|---|---|
| 57-073166 | 5/1982 | Japan . |
| 58-113356 | 7/1983 | Japan . |
| 58-185751 | 10/1983 | Japan . |
| 59-133352 | 7/1984 | Japan . |
| 2-232341 | 9/1990 | Japan . |
| 3-134136 | 6/1991 | Japan . |
| WOA93/02818 | 2/1994 | WIPO . |

OTHER PUBLICATIONS

Steven et al. "High–Performance High–Speed Steels by Design", *Transactions of the ASM,* vol. 57, 1964, pp. 925–948.

Mizuno et al. "The Influence of Alloying Elements on the Morphology of MC Primary Carbide Precipitation in Mo–Type High Speed Tool Steel", *Electric Steel Making,* vol. 55, No. 4, 1984.

*Primary Examiner*—Sikyin Ip

*Attorney, Agent, or Firm*—Sughrue, Mion, Zinn, Macpeak & Seas

[57] ABSTRACT

Disclosed is a high-speed steel member and manufacturing method thereof. The member has Nb content of 0(incl.) to 2.0 (excl.) % in the hard state after hardening and tempering and in its micro-structure, contains either or both of $M_6C$ and $M_2C$ type carbides representing a rate of 0 to 2% to the total area, and the remainder substantially consisting of MC type carbide. The difference of crystallization temperatures is 30° C. or more between MC type carbide and $M_6C$ or $M_2C$ type eutectic carbide. The high-speed steel member exhibits a high toughness and a small anisotropy of the mechanical property namely, a hardness of HRC 60 or more and a Charpy impact value ratio between the longitudinal direction and the direction perpendicular thereto in a forged material is 0.7 or more and are quite useful for plastic working.

3 Claims, 1 Drawing Sheet

25 μm

25 μm

25 μm

HIGH TOUGHNESS HIGH-SPEED STEEL MEMBER AND MANUFACTURING METHOD

This is a continuation of application No. 08/241,988 filed May 13, 1994, now abandoned.

FIELD OF THE INVENTION

The present invention relates to a high-speed steel member with a high toughness used for plastic working and a manufacturing method thereof.

BACKGROUND OF THE INVENTION

The steel referred to as high-speed steel has a microstructure containing two forms of primary carbide. One is a complex carbide called $M_6C$ or $M_2C$, whose crystal structure constitutes cubic system with a composition of $Fe_3(W, Mo)_3C$ or $Fe_4(W, Mo)_2C$. The other is a mono carbide called MC with a composition of (V, Ti, Nb)C. The former is formed as herringborn-like or feather-like eutectic carbides obtained in eutectic reaction during solidification process of molten steel where austenite (γ) and $M_6C$ ($M_2C$) type carbides are simultaneously crystallized from melt (L). In case of the latter, crystallization style is a little complicated: The MC type carbide may be formed in two solidification types, one is crystallized alone in the melt (L) and the other is formed during eutectic reaction. The MC type carbide crystallized alone Is first formed as a single type crystal from the melt (L) in solidification process. Then, in the eutectic reaction where austenite (γ) and MC type carbide are simultaneously crystallized from the melt (L), MC type carbide may be formed again.

In case of ordinary high-speed steel, $M_6C$ ($M_2C$) type carbide, which is an eutectic carbide, is generated much more than MC type carbide, which is crystallized alone, of the above primary carbides. Besides, $M_6C$ ($M_2C$) type carbides are always generated in eutectic reactions under general industrial conditions for ingot making and cannot be crystallized alone. According to Steven (G. S. Steven, A. E. Nehrenberg: Trans ASM57(1967) p.925), the eutectic temperature here can be expressed in weight % of the elements as shown below:

Formula: $TM_6C$ (°F)=2310−200(% C)+40(% V)+8(% W)+5(% Mo)

When the crystallization temperature difference between MC type carbide and the $M_6C(M_2C)$ type eutectic carbides is expressed as ΔT(°C.), the more V, Si, N and C are contained and the less W and Mo are included in a steel, the larger the difference ΔT(°C.) becomes. In general, higher ΔT (°C.) involves more coarse MC type carbide, which lowers steel grindability.

To provide the structure with a finer MC type carbide, it is proposed to decrease the crystallization temperature difference between MC type carbide and $M_6C$ ($M_2C$) type carbide by adjusting the alloying elements (Electric Steel Making, vol. 55, No. 4, 1984, p.225).

According to a conventional method to improve the grindability of high-speed steel, MC type carbide forming elements such as Nb, Ta and TI are added only by a limited amount so as to have finer MC type carbides and content of N is reduced for crystallization of MC type carbides at a lower temperature. This method is to minimize the crystallization temperature difference between MC type carbide and $M_6C$ or $M_2C$ type eutectic carbide and thereby prevent coarsening of MC type carbide. Further, addition of rare earth elements such as Ce for combination with N is known to have a similar effect.

However, even when coarsening of MC type carbide is prevented by the above method, it is still inevitable that primary carbide $M_6C$ or $M_2C$ is generated as a eutectic carbide.

Primary carbides generated in eutectic reaction are formed into a combined network style during casting process and have a continuous irregular shape. To obtain an excellent member for plastic working with superior mechanical properties from a steel ingot having such a structure, it is important to destroy eutectic carbides by hot working or other means so as to form granular crystals. However, if the forging ratio is not sufficient in relation to product dimensions in forging process, a stripe (streak, hook) structure with crowded distribution of eutectic carbides is generated in longitudinal direction of forged material. Such distribution may cause anisotropy in mechanical properties of the product.

In addition, eutectic carbides cannot be made into solid solution during the subsequent soaking process. Segregation of stripe carbide during hot or cold working is not solved yet.

If such a product is used as a member for plastic working, cracks may occur from the interface between the primary carbides and the matrix, which deteriorates mechanical properties. To solve this problem with improving toughness of the member at the same time, it is effective to reduce the amount of primary carbide, to have finer carbide and to prevent crowded distribution of the primary carbide in longitudinal direction of the forged material. For this purpose, "matrix high-speed steel" with lower amount of primary carbide and powder high-speed steel with micro-sized primary carbide are widely used. However, the former has only a low hardness and involves insufficient absolute values of mechanical properties when used to produce large diameter materials where forging ratio is not sufficient. The latter costs too high and it is difficult to be used popularly.

SUMMARY OF THE INVENTION

It is an object of the present invention to provide a high-speed steel member with a high toughness and a small anisotropy of mechanical property and a manufacturing method thereof, by an innovative concept clearly distinguished from conventionally known high-speed steel member and manufacturing method thereof.

The high-speed steel member of the present invention has Nb content of 0(incl.) to 2.0(excl.) wt. % in the hard state after hardening and tempering. In its micro-structure, either or both of $M_6C$ and $M_2C$ type carbides among the primary carbides represent a area rate of 0(incl.) to 2 (incl.) % to the total area, and the remainder substantially consists of MC type carbide.

Further, according to the high-speed steel member of the present invention, the difference of crystallization temperatures is 30° C. or more between MC type carbide and $M_6C$ or $M_2C$ type eutectic carbide. MC type carbides have a non-eutectic solidification structure.

The high-speed steel member of the present invention has a hardness of HRC 60 or more and a Charpy impact value ratio between the longitudinal direction and the direction perpendicular thereto in a forged material of 0.7 or more.

The high-speed steel member of the present invention comprises, by weight percent, 0.5 to 2.0% of C, 2.0% or less of Si, 1.5% or less of Mn, 3.5 to 6.0% of Cr, 2.0 or less of W, 3.0 to 6.0 % of Mo, 0.5% or more in total of both or either of V (5.0% or less) and Nb (less than 2.0%), 0.02 to 0.07% of N, as well as Fe and inevitable impurities for the remainder. Among the above elements, a part of Fe may be replaced by 12.0 % or less of Co or 0.10% or less of Ti, if necessary.

DETAILED DESCRIPTION OF THE INVENTION

Figure 1:
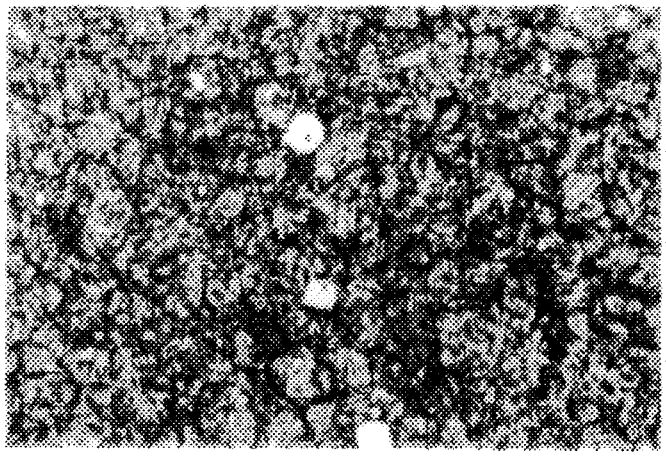
FIG. 1 is a photograph of micro-structure after hardening and tempering of a high-speed steel member according to the present invention.

Thorough investigation has been made into formation conditions for MC type carbide and $M_6C$ ($M_2C$) type carbides as primary carbides of the high-speed steel member and the relation between these carbides and mechanical properties of the member. As a result, it is found that MC type carbide deteriorates mechanical properties of the member less, since it is formed as relatively dispersed single type crystals compared with $M_6C$ or $M_2C$ type eutectic carbide, which leads to more uniform distribution of MC type carbides after hot working than eutectic carbides.

Further, MC type carbide crystallized alone as single type crystals remains unsolved even after austenitizing. This provides the member with wear resistance, and acts in preventing austenite crystal grains from being coarse.

To crystallize MC type carbide alone as single type crystals, it is effective to arrange its crystallization temperature to be different from that of $M_6C$ and $M_2C$ type carbides at 30° C. or more.

Eutectic reaction from the melt (L) to austenite (γ) and $M_6C$ ($M_2C$) type carbide observed in conventional high-speed steel is suppressed by the adjustment of the material composition in the present invention. At the same time, $M_6C$ and $M_2C$ type eutectic carbides crystallized in non-equilibrium state are formed into solid solution in the matrix by high temperature soaking. Thus, $M_6C$ or $M_2C$ type eutectic carbide content is limited below a fixed value or is substantially eliminated, and MC type carbide alone is distributed in the matrix. Such high-speed steel member is found to have much improved mechanical properties including, in particular, absolute values for toughness and small anisotropy.

High-speed steel member of the present invention comprises, by weight percent, 0.5 to 2.0% of C, 2.0% or less of Si, 1.5% or less of Mn, 3.5 to 6.0% of Cn, 3.0 to 6.0% of Mo, 0.5% or more in total of either or both of V (5.0% or less) and Nb (less than 2.0%) and 0.02 to 0.07% of N, as well as Fe and inevitable impurities for the remainder.

Alternatively, high-speed steel member of the present invention comprises, by weight percent, 0.5 to 2.0% of C, 2.0% or less of Si, 1.5% or less of Mn, 3.5 to 6.0% of Cr, 2.0% or less of W, 3.0 to 6.0% of Mo and 0.5% or more in total of either or both of V (5.0% or less) and Nb (less than 2.0%) and 0.02% to 0.07% of N, as well as Fe and Inevitable Impurities for the remainder.

Among the composition elements above, a part of Fe may be replaced by Co or Ti, if necessary, for a range of 12.0% or less for Co and 0.10% or less for Ti.

The manufacturing method of the high-speed steel member according to the present invention comprises a soaking process where the steel with the above composition is placed in a temperature from 1100° to 1200° C. before or during hot working.

The high-speed steel member of the present invention contains 0 (incl.) to 2.0 (excl.) % of Nb in hard state after hardening and tempering. Among the primary carbides in the structure, the area rate of $M_6C$ and/or $M_2C$ type carbides represent 0(incl.) to 2 (incl.) % in total In the whole area, and the remainder is substantially MC type carbide.

Besides, in the high-speed steel member according to the present invention, the difference of crystallization temperature is 30° C. or more between MC type carbide and $M_6C/M_2C$ type eutectic carbide. MC type carbide has a non-eutectic solidification structure.

With a structure having the above carbide distribution, the high-speed steel member of the present invention has a hardness of HRC 60 or more and its ratio of Charpy impact values between longitudinal direction and the direction perpendicular thereto in a forged material can be 0.7 or more. Note that a hardness less than HRC 60 results in insufficient wear resistance for a plastic working material. It is desirable that the hardness is HRC 60 or more in hard state after hardening and tempering. To provide the hardness of HRC 60 or more to the member in the hard state after hardening and tempering, 6% or more of W+2Mo is desirably formed into solid solution in the matrix.

The present invention shows a contrast to the conventional method where the difference in crystallization temperature between $M_6C$ and $M_2C$ type carbides and MC type carbide is to be minimized by lowering the crystallizing temperature of MC type carbide. According to the present invention, the difference ΔT (°C.) is increased so that only MC type carbide is crystallized as granular form in solidification process. Then, $M_6C$ and $M_2C$ type eutectic carbides are limited to an area within 2% at most, i.e. finally eliminated by soaking. This process weakens improper mechanical properties of the member, or in particular, anisotropy of the toughness, though a little bit coarsening of MC type carbide may occur.

When the total of $M_6C$ type and $M_2C$ type carbides exceeds 2% of the total area, the anisotropy of mechanical properties becomes prominent. Therefore, it is desirable that above eutectic carbides do not exist in the structure at all.

When the crystallization temperature difference between MC type carbide and $M_6C$ type/$M_2C$ type carbides is 30° C. or more, MC type carbide as single type crystals tend to be crystallized in the granular form, which effectively reduces the anisotropy of mechanical properties of the member. When the temperature difference is below 30° C., MC type carbide is formed more in eutectic state. Since it is difficult to sufficiently eliminate such MC type carbide in eutectic state during subsequent heat treatment and hot working, this may emphasize the anisotropy of the toughness.

Given below are reasons for composition limitation in relation to high-speed steel member according to the present invention.

Among the constituent elements, C not only works for martensite hardening of the matrix, but also serves as the element source for precipitated carbides during tempering in combination with Cr, W, Mo and V and the element source for MC type carbide. At the same time, it is an indispensable element with an effect to raise the crystallization temperature of MC type carbide. Its amount should be decided corresponding to the amount of other elements. It is preferable to add 0.5% to 2.0% of C in relation to the contents of Cr, W, Mo, V and Nb described later.

Si is used as a deoxidant. It also has an effect to raise the crystallization temperature of MC type carbide and contributes to improvement of tempering hardness. However, its existence for over 2.0% eminently lowers the toughness. Lower Si amount is desirable for higher toughness. Corresponding to the required hardness, Si should be used for an amount of 2.0% or below.

Mn has a deoxidation effect and is preferably added by 1.5% or less.

Cr is an indispensable element to improve the hardening property of the member. Its existence for less than 3.5% causes poor hardening property and existence for over 6.0% lowers the absolute value for hardness. It is preferably used for an amount from 3.5 to 6.0%.

Mo is to be added so as to represent 3.0 to 6.0%. Mo serves as the Mo source for precipitated carbide $Mo_2C$ in tempering, which is the major cause of secondary hardening. Unlike the conventional high-speed steel, Mo is basically not required for formation of primary carbides. If the added amount is less than 3.0%, Mo cannot produce the secondary hardening effect sufficiently, but if it is over 6.0%, such amount is over the equilibrium crystallizing limit for eutectic carbides.

W has a similar effect to Mo. W may be added for 2% or less, if required.

Both of V and Nb have a strong tendency for formation of MC type carbide. They leads to crystallization of primary carbides VC and NbC respectively. While NbC hardly dissolve into the matrix with austenitizing at 1300° C. or below, VC has a considerable solid solubility in the matrix at 1100° C. or more. Crystallization of MC type carbides results in increasing the wear resistance of the member. Furthermore, V and Nb serve for prevention of coarse crystal grains. When either or both of V and Nb represents less than 0.5%, the above effect is hardly achieved, therefore, the preferable content is at 0.5% or more. Besides, when V exceeds 5.0% or Nb represents 2.0% or more. MC type carbide has coarse grains which deteriorates the toughness. The respective upper limits are 0.5% (incl.) and 2.0% (excl.).

N is an effective element to increase the difference in crystallization temperature T (°C.) between MC type carbide and $M_6C/M_2C$ type carbides. N is added for 0.02 to 0.07%. When N is below 0.02%, it cannot serve to increase the temperature difference; when it is over 0.07%, MC type carbide becomes too large, which may lower the toughness.

Addition of Co improves temper hardening as in conventional high-speed steel member. However, when the amount is over 12.0%, Co deteriorates the hot workability. The element is to be arbitrarily added for an amount below 12.0% corresponding to the desired hardness of the member.

Similar to N, Ti increases difference in crystallization temperature ΔT (°C.) between MC type carbide and carbides of $M_6C/M_2C$ type. Ti is added for an amount not more than 0.1%. When Ti content exceeds 0.1%, MC type carbide becomes too large, which may lower toughness. Added at the same time, Ti and N can cooperate in finer crystallization of MC type carbide during solidification.

Usually, the cast structure of steel ingot obtained in mass production tends to be easily solidified in non-equilibrium state. In case of high-speed steel, the amount of primary carbide formed in non-equilibrium state is larger than that formed in equilibrium state. The eutectic carbide remaining in equilibrium state cannot be eliminated by subsequent heat treatment and hot working processes. However, $M_6C$ type and $M_2C$ type eutectic carbides crystallized in non-equilibrium state can be forcibly made into solid solution In the matrix by means of high temperature soaking. The soaking is preferably made to steel ingot having a small surface area or in the initial stage of hot working. Preferable treatment temperature is in the range from 1100° to 1200° C. It is not effective under 1100° C. Over 1200° C., a part of eutectic carbide melts again, which deteriorates subsequent hot workability.

Being forcibly made into solid solution, Mo and W are effective in increasing the density in the matrix, enhancing the softening resistance in tempering, increasing the hardness of the member and raising absolute values of its mechanical properties. Such effect is particularly prominent in the composition range according to the present Invention. In an Improper composition, soaking causes Ostwald growth of carbides, which makes the carbides more coarse with deteriorating the hardness and mechanical properties of the member.

EXAMPLE 1

Table 1 shows the compositions of conventional high-speed steel and the material used for the high-speed steel member according to the present invention. Small laboratory ingots of 50 kg were heated to 1140° C. for hot forging up to 60 mm square, which corresponds to a forging ratio of 10. After forging, a small test piece of 10 g was cut out of each sample for measurement of crystallization temperature for MC type carbide and $M_6C/M_2C$ type eutectic carbides during solidification using a differential thermal analysis meter. To measure the crystallization temperature, the test pieces were heated to 1450° C. to be molten and then cooled down at an average cooling rate of 10° C./min. The temperature values were determined from exothermic and endothermic changes during the cooling process. Table 2 shows the determined crystallization temperature difference ΔT (°C.) between MC type carbide and $M_6C/M_2C$ type carbides.

TABLE 1

| | Composition (wt. %) | | | | | | | | | | | |
|---|---|---|---|---|---|---|---|---|---|---|---|---|
| Samples | C | Si | Mn | Cr | W | Mo | V | Co | N | Ti | Nb | Fe |
| Comp. Ex. | | | | | | | | | | | | |
| AISI M50 | 0.80 | 0.25 | 0.23 | 4.10 | — | 4.25 | 1.03 | — | 0.006 | — | — | balance |
| AISI Class364 | 0.95 | 0.24 | 0.31 | 4.03 | 2.96 | 2.44 | 2.31 | 0.08 | 0.030 | — | — | balance |
| AISI Class368 | 1.10 | 0.27 | 0.24 | 4.10 | 2.50 | 2.63 | 4.05 | — | 0.024 | — | — | balance |
| SKH51 | 0.65 | 0.30 | 0.31 | 4.20 | 4.18 | 4.03 | 1.50 | — | 0.024 | — | — | balance |
| Matrix Steel A | 0.64 | 1.51 | 0.38 | 4.18 | — | 2.85 | 1.80 | — | 0.031 | — | — | balance |
| Matrix Steel B | 0.80 | 1.24 | 0.28 | 4.20 | 1.50 | 4.00 | 0.90 | — | 0.028 | — | — | balance |

TABLE 1-continued

| Samples | Composition (wt. %) | | | | | | | | | | | |
|---|---|---|---|---|---|---|---|---|---|---|---|---|
| | C | Si | Mn | Cr | W | Mo | V | Co | N | Ti | Nb | Fe |
| Example | | | | | | | | | | | | |
| RV693 | 0.69 | 0.80 | 0.30 | 5.07 | — | 4.03 | 0.98 | — | 0.041 | — | — | balance |
| RV694 | 0.70 | 0.82 | 0.24 | 5.07 | — | 4.02 | 1.03 | 5.04 | 0.050 | 0.035 | — | balance |
| RV600 | 0.71 | 0.68 | 0.18 | 5.21 | — | 3.99 | 0.96 | 8.23 | 0.035 | 0.041 | — | balance |
| RV695 | 0.67 | 0.77 | 0.31 | 5.14 | — | 4.08 | — | — | 0.043 | — | 0.31 | balance |
| RV601 | 0.90 | 0.83 | 0.24 | 5.13 | 0.30 | 4.12 | 2.03 | — | 0.040 | — | — | balance |
| RV602 | 1.00 | 0.94 | 0.31 | 5.35 | 0.28 | 4.33 | 2.71 | — | 0.043 | 0.035 | — | balance |
| RV603 | 1.50 | 0.83 | 0.27 | 4.61 | 0.41 | 4.51 | 3.52 | — | 0.051 | 0.028 | — | balance |
| RV604 | 1.03 | 0.87 | 0.31 | 5.07 | 0.81 | 4.51 | 2.50 | 8.00 | 0.043 | 0.035 | — | balance |
| RV700 | 0.64 | 0.14 | 0.21 | 3.70 | — | 3.94 | 0.83 | — | 0.037 | — | 0.31 | balance |
| RV701 | 1.40 | 0.11 | 0.18 | 5.13 | 1.59 | 3.68 | 4.34 | — | 0.041 | — | — | balance |
| RV702 | 0.60 | 0.25 | 0.22 | 5.10 | 0.30 | 3.80 | — | — | 0.033 | — | 0.88 | balance |

Next, for Charpy impact test, test pieces of 10 mm×10 mm×55 mm (10 R C notch) were sampled from forging direction (L) and in the direction perpendicular thereto (T) for each hot forged specimen after annealing. The test pieces were roughly machined and then hardened at a temperature 40° C. lower than the crystallization temperature of $M_6C$ and $M_2C$ type eutectic carbides. After oil cooling, the test pieces were tempered at 560° C. for one hour for two or three times and then finished to the specified dimensions and subjected Charpy impact test.

Further, the samples after Charpy impact test were subjected to etch for MC type carbide and $M_6C$ and $M_2C$ type carbides, respectively. Then, with an image analize processor, area of the carbides were measured for determination of their ratio. Table 2 shows the results.

TABLE 2

| Samples | Primary Carbide Area Ratio | | | Hardness | Sharpy Impact Value (kgm/cm²) | | |
|---|---|---|---|---|---|---|---|
| | $M_2C + M_6C$ | MC | Δ T(°C.) | HRC | (L) dir. | (T) dir. | T/L Ratio |
| Comp. Ex. | | | | | | | |
| AISI M50 | 2.3 | 0.8 | 15 | 63.5 | 2.8 | 1.5 | 0.54 |
| AISI Class364 | 3.3 | 3.1 | 25 | 65.1 | 1.0 | 0.5 | 0.50 |
| AISI Class368 | 2.7 | 15.4 | 29 | 64.0 | 1.2 | 0.6 | 0.50 |
| SKH51 | 7.2 | 1.7 | 18 | 63.3 | 3.4 | 1.4 | 0.41 |
| Matrix Steel A | 2.1 | 4.4 | 22 | 59.4 | 7.3 | 4.0 | 0.55 |
| Matrix Steel B | 2.5 | 1.0 | 26 | 64.5 | 5.1 | 3.1 | 0.61 |
| Example | | | | | | | |
| RV693 | 0.3 | 0.8 | 38 | 63.0 | 6.0 | 4.8 | 0.80 |
| RV694 | 0.2 | 1.0 | 42 | 64.1 | 6.8 | 5.8 | 0.85 |
| RV600 | 0.6 | 0.8 | 40 | 65.2 | 5.5 | 4.6 | 0.84 |
| RV695 | 0.7 | 1.1 | 45 | 62.0 | 7.0 | 6.1 | 0.87 |
| RV601 | 0.7 | 5.6 | 75 | 61.8 | 3.8 | 3.0 | 0.79 |
| RV602 | 0.8 | 9.6 | 93 | 61.6 | 2.6 | 2.0 | 0.77 |
| RV603 | 0.9 | 18.0 | 110 | 61.2 | 1.6 | 1.2 | 0.75 |
| RV604 | 0.6 | 8.4 | 88 | 66.0 | 2.8 | 2.1 | 0.75 |
| RV700 | 0.2 | 1.1 | 48 | 63.2 | 8.9 | 6.4 | 0.72 |
| RV701 | 0.1 | 20.1 | 81 | 62.0 | 1.5 | 1.1 | 0.73 |
| RV702 | 0.1 | 0.9 | 48 | 61.4 | 5.0 | 3.8 | 0.76 |

As shown in Table 2, while the conventional steel has the difference ΔT (°C.) of less than 30° C., the high-speed steel of the present invention has the difference of 35° C. or more, which becomes 110° C. at maximum. This is largely attributable to concurring addition of Ti and N for small amount.

The primary carbide area ratios for $M_6C$ type and $M_2C$ type carbides formed in eutectic reaction is 1.5% or less in high-speed steel member of the present invention. This value satisfies the condition of "2.0% or less" required in the present invention.

The area ratio of MC type carbide is closely related to V and Nb contents in the steel. It gradually grows as the amount of V and/or Nb increases.

Figure 2:
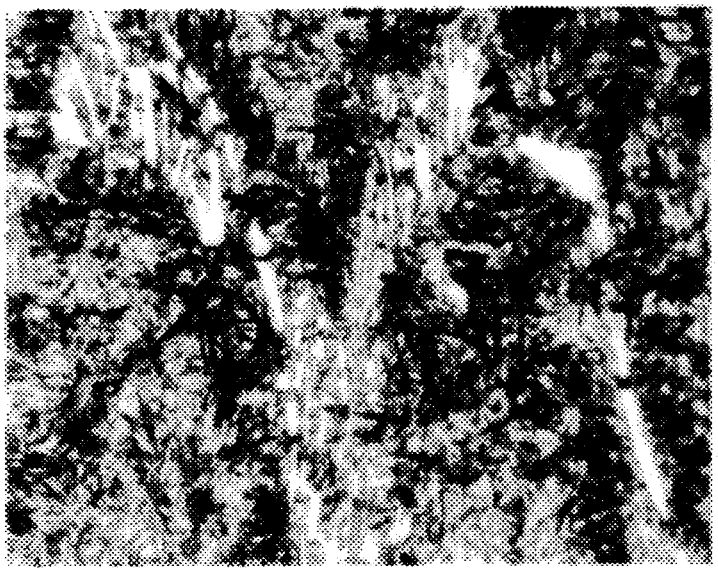
FIG. 2 PRIOR ART
FIG. 2 is a photograph of micro-structure after hardening and tempering of a conventional high-speed steel member.

FIGS. 1 and 2 show the micro-structure after hardening and tempering of RV693, an example of the present invention in Tables 1 and 2, and of matrix steel A, an example of the conventional steel.

As understood from FIG. 1, the high-speed steel member of the present invention has a structure with dispersed grains of MC type carbide having a substantially spherical shape, which practically has no $M_6C$ or $M_2C$ type eutectic carbide in the form of a net. The hardness after hardening and tempering is HRC 60 or more. Further, mechanical properties in forging direction (L) and the direction perpendicular thereto (T) are sufficient; more specifically, T/L ratio of Charpy Impact is 0.7 or more, or even 0.85 at most, which is tremendously higher than that in conventional steels. It is quite noteworthy to show such a high T/L ratio for a forging ratio of 10. The Charpy impact values are also high for the hardness in both forging direction and the direction perpendicular thereto.

EXAMPLE 2

Among the samples of Table 1, three types of materials SKH51, RV693 and RV695 with low C content were subjected to soaking at 1180° C. for 20 hours when they were in the form of steel ingots. Then, as In Example 1, the materials were hot forged and subjected to Charpy impact test for determination of carbide area ratios. Table 3 shows the results.

TABLE 3

| | | Primary Carbide Area Ratio | | | Hardness | Sharpy Impact Value ($kgm/cm^2$) | | |
|---|---|---|---|---|---|---|---|---|
| | Samples | $M_2C + M_6C$ | MC | Δ T(°C.) | HRC | (L) dir. | (T) dir. | T/L Ratio |
| Comp. Ex. | SKH51 | 7.5 | 1.9 | 18 | 62.8 | 3.0 | 1.2 | 0.40 |
| Example | RV693 | 0.1. | 1.0 | 38 | 63.5 | 6.5 | 5.6 | 0.86 |
| Example | RV695 | 0.2 | 1.1 | 45 | 62.4 | 7.0 | 6.5 | 0.93 |

As shown in Tables 2 and 3, for SKH51 with low C content, soaking slightly increased the area ratio of primary carbides. Since the primary carbides had been formed in equilibrium state, they could not be eliminated in soaking, but were caused to become more coarse by Ostwald growth due to high temperature. This slightly deteriorated the hardness and absolute values of mechanical properties.

In contrast, the high-speed steel member of the present invention had, even before soaking, 0.7% or less of eutectic carbides. During soaking, $M_6C$ and $M_2C$ type carbides crystallized in non-equilibrium state solved into the matrix, or they disappeared substantially. In this case, solid solution of carbides into the matrix increases the amount of alloyed elements in the matrix, which slightly increases the tempering hardness and improves the absolute values of mechanical properties, with weakening the anisotropy.

EXAMPLE 3

The steel with the composition of RV695 according to the present invention as shown in Table 1 was manufactured in mass production scale and hot forged into a bar material with a diameter of 200 mm. For reference, another steel with the composition of SKH51 having low C content according to Table 1 was also manufactured in mass production scale and hot forged into a bar material with same diameter. From both 200 mm dia. materials, rolled dies for deep groove forming were made for comparison of practical use.

Heat treatment conditions included hardening at 1120° C. and then tempering at 560° C. for the steel equivalent to RV695. Hardness was HRC 62.2. The steel equivalent to SKH51 was hardened at 1150° C. and then tempered at 560° C. Hardness was HRC 63.3. in the actual performance test with using rolled dies, forming weight was 6 tons and forming speed was 6 m/sec. The number of formed material until generation of any cracking flaw in the dies to be transferred to the formed material was counted for determination of service life of the member.

As a result, while the rolled dies made of the steel equivalent to SKH51 with low C content suffered a crack after forming of 275 products, the rolled dies made of the steel material according to the present invention could form 42,000 products.

As described above, the high-speed steel member according to the present invention has an innovative microstructure, which has alloy composition of high-speed steel but does not contain any eutectic carbide substantially, in other words, it has a structure where MC type carbide alone among primary carbides is uniformly dispersed. It is a quite useful material as a high toughness high-speed steel member with a high Charpy impact value and a hardness of HRC 60 or more as well as a ratio of Charpy impact values between forging direction and the direction perpendicular thereto of 0.7 or more.

What is claimed is:

1. A high toughness high-speed steel member consisting essentially of, by weight %, 0.5 to 2.0% of C, 2.0% or less of Si, 1.5% or less of Mn, 3.5 to 6.0% of Cr, 0 to 2.0% of W, 3.0 to 4.51% of Mo, 0.5% or more in total of either or both of V and Nb wherein the amount of V is 5.0% or less and wherein the amount of Nb is less than 2.0%, and 0.02 to 0.07% of N and a remainder of Fe, and has a microstructure consisting essentially of, among primary carbides, one of $M_6C$ and $M_2C$ carbides or both of them in total representing 0 to 2% of area ratio in the whole area and a remainder consisting of MC carbides, wherein the crystallization temperature difference between the MC carbides and the $M_6C$ or $M_2C$ carbides is 30° C. or more and the primary MC carbide has a non-eutectic solidification structure, and wherein the steel member has a hardness HRC of 60 or more and a ratio of Charpy impact values between a forging direction and a direction perpendicular thereto of 0.7 or more.

2. A high toughness high-speed steel member according to claim 1, wherein a part of Fe is replaced by 12.0% or less of Co.

3. A high toughness high-speed steel member according to claim 1, wherein a part of Fe is replaced by 0.10% or less of Ti.

* * * * *